US010172227B2

(12) United States Patent
Castillo Acero et al.

(10) Patent No.: US 10,172,227 B2
(45) Date of Patent: Jan. 1, 2019

(54) PLASMA ACCELERATOR WITH MODULATED THRUST

(71) Applicants: AERNNOVA, Illescas-Toledo (ES); UNIVERSIDAD POLITECNICA DE MADRID, Madrid (ES)

(72) Inventors: Miguel Angel Castillo Acero, Madrid (ES); Luis Conde Lopez, Madrid (ES); Juan Luis Domenech Garret, Madrid (ES); Jose Manuel Donoso Vargas, Madrid (ES); Ezequiel Del Rio Fernandez, Madrid (ES)

(73) Assignees: AERNNOVA, Madrid (ES); UNIVERSIDAD POLITECNICA DE MADRID, Madrid (ES)

( * ) Notice: Subject to any disclaimer, the term of this patent is extended or adjusted under 35 U.S.C. 154(b) by 0 days.

(21) Appl. No.: 15/769,251

(22) PCT Filed: Oct. 27, 2015

(86) PCT No.: PCT/EP2015/074879

§ 371 (c)(1),
(2) Date: Apr. 18, 2018

(87) PCT Pub. No.: WO2017/071739

PCT Pub. Date: May 4, 2017

(65) Prior Publication Data

US 2018/0310393 A1 Oct. 25, 2018

(51) Int. Cl.
*H05B 33/00* (2006.01)
*H05H 1/54* (2006.01)
(Continued)

(52) U.S. Cl.
CPC ..... *H05H 1/54* (2013.01); *F03H 1/0018* (2013.01); *F03H 1/0056* (2013.01); *H01J 27/205* (2013.01); *H05H 1/24* (2013.01)

(58) Field of Classification Search
CPC ..... H01J 2201/319; H01J 2201/30469; H01J 9/025; H01J 1/3046; H01J 1/316;
(Continued)

(56) References Cited

U.S. PATENT DOCUMENTS

| | | | |
|---|---|---|---|
| 3,913,320 | A | 10/1975 | Reader et al. |
| 5,369,953 | A | 12/1994 | Brophy |
| 2010/0207527 | A1 | 8/2010 | Hruby et al. |

FOREIGN PATENT DOCUMENTS

| | | | |
|---|---|---|---|
| EP | 0505327 | A1 | 9/1992 |
| WO | 99/28624 | A1 | 6/1999 |
| WO | 2011088335 | A1 | 7/2011 |

OTHER PUBLICATIONS

International Search Report and Written Opinion dated Jul. 6, 2016 for PCT/EP2015/074879.

*Primary Examiner* — Monica C King
(74) *Attorney, Agent, or Firm* — Lucas & Mercanti, LLP

(57) ABSTRACT

The invention relates to a plasma accelerator that produces and controls a plasma stream exhaust, in particular for space propulsion. The ions are produced inside the discharge chamber by working gas collisional ionization by electrons from a single electron source placed outside, also employed for ion beam neutralization. The ion motion is directed outwards through the exit side by the electric field between a cathode grid and the walls of the plasma chamber. The acceleration voltage imparts energy to the ion flux and an electrically biased control grid modulates the ion outflow from the discharge chamber and the electron inflow from the electron source. This allows electrical control of throttle and/or modulation of thrust delivered along the longitudinal direction of the thruster axis. Several plasma accelerators could be clustered together to provide controlled non-axial thrust using the individual control of throttle.

10 Claims, 2 Drawing Sheets

(51) Int. Cl.

| | |
|---|---|
| ***F03H 1/00*** | (2006.01) |
| ***H05H 1/24*** | (2006.01) |
| ***H01J 27/20*** | (2006.01) |

(58) Field of Classification Search

CPC ..... H01J 2201/3165; H01J 2329/02; H01J 2329/0489; H01J 2329/323; H01J 2329/8625; H01J 2329/863; H01J 2329/864

See application file for complete search history.

PLASMA ACCELERATOR WITH MODULATED THRUST

CROSS REFERENCE TO RELATED APPLICATION

This Application is a 371 of PCT/EP2015/074879 filed on Oct. 27, 2015, which is incorporated herein by reference.

FIELD OF THE INVENTION

The present invention relates to ion sources employed as plasma thrusters for space propulsion and in-orbit corrections of space probes and satellites.

BACKGROUND

Ion thrusters and plasma accelerators produce high velocity streams of ions and electrons that impart momentum to spacecrafts. The propulsion of satellites using plasma streams is in increasing demand in order to improve the performances of satellites. An important limiting factor is the depletion of propellant, essential for in-orbit maneuvers, which eventually might force early satellite retirement. These orbit corrections and changes of orientation compensate the small variations produced in the periodic motion of satellites by the gravitational forces of the sun, the moon, as well as by the irregular distribution of the Earth's mass. Replacing the usual chemical rocket engines with plasma-based propulsive systems, characterized by high propellant exhaust speeds and large values of specific impulse, increases the operational lifetime of satellites.

In plasma propulsion devices the neutral gas employed as propellant is introduced into a lengthwise cavity called discharge or plasma chamber. The latter is made of different shapes and materials and has an open side to allow ion outflow. The plasma composed of electrons and ions is produced inside the discharge chamber by neutral gas atom collisional ionization by electrons emitted from active cathodes. As used herein, the term "active cathode" refers to electron emitting electrodes having substantial emission current densities, roughly over $10^{-2}$ A/cm$^2$. These devices, such as hollow cathodes or thermionic electron emitters, could be operated as electron sources. Otherwise, "passive cathodes" also are negatively polarized electrodes but having much lower or negligible electron emission current densities, typically below $10^{-3}$ A/cm$^2$.

The ions from this plasma flow through the open side of the discharge chamber and are accelerated by different physical mechanisms. The thrust is imparted to the spacecraft by the plasma stream created when electrons are added to the high energy ion beam to neutralize space charge effects. This plasma stream composed of electrons and ions could also be used in material processing applications by directing the energized ion outflow over the surface of materials in order to modify their physical properties.

Electrostatic plasma accelerators can be roughly classified as gridded ion engines, Hall effect thrusters and multi-stage plasma accelerators. Only gridded ion engines deliver variable or modulated thrust by electrical control of the speed of the plasma stream exhaust, holding other operational parameters of the thruster constant. Such control or modulation of throttle is essential for orbital maneuvers and/or flight formation of satellites. Other propulsive systems deliver a fixed thrust essentially determined by plasma discharge parameters such as the current of ionizing electron flow, neutral gas mass flow rate, etc.

Gridded ion engines produce the electrostatic acceleration of ions extracted from a plasma and are disclosed in U.S. Pat. No. 4,466,242, U.S. Pat. No. 3,956,666, U.S. Pat. No. 3,969,646 or EP 073380061. The conductive walls of the discharge chamber constitute the anode of an electric discharge, triggered by ionizing electrons emitted by a first active cathode placed inside.

A minimum set of two multi-aperture parallel grids are disposed in front of the open side of the discharge chamber for the extraction and acceleration of the ion beam. The first grid, currently called extraction or screen grid, is electrically connected to the active cathode and allows the ions to pass through its open spaces. The second grid is biased to high voltages and accelerates the flow of outgoing ions. Finally, a second active cathode disposed beyond the grids provides electrons to neutralize space charge effects of the ion beam and produces the plasma stream exhaust. The acceleration voltage of the second grid allows modulating the speed of outflowing ions and therefore the delivered thrust by the ion engine.

A third decelerator grid described in U.S. Pat. No. 5,369,953 and U.S. Pat. No. 5,559,391 is used to avoid charge exchange collisions between ions and neutral atoms and also reduces erosion of the accelerator grid by the electron backflow from the second active cathode employed for ion beam neutralization. This protective grid extends the lifetime of the system. Additional improvements of this basic scheme have been disclosed, such as higher ion production rates by means of multi-cusp magnetic fields inside the discharge chamber as in U.S. Pat. No. 4,466,242, or improved accelerator grids in US 2010/0212284A1.

Gridded ion engines require a minimum of two active cathodes and therefore a number of power supplies that increase the complexity of the electrical system, as well as the electric power consumption. Thermal control also becomes an issue because of the high operational temperatures of active cathodes, typically over 2000 K. Different thruster elements are heated up to high temperatures by the released infrared radiation. Additionally, the high bias voltages required for ion beam acceleration, typically of a few kilovolts, also give rise to sparking and electric arcing between the grids, also subjected to both thermal stresses and charged particle bombardment. All these factors reduce the lifetime of gridded ion engines.

The principle of the plasma accelerator called Hall thruster is the electrostatic acceleration of ions without the grids required by ion thrusters. This configuration, described in EP 0541309A1 or U.S. Pat. No. 8,468,794, is simpler and needs fewer power supplies to operate. The discharge chamber is a cylindrical ring-shaped cavity made of a non-conductive or ceramic material extended along its axial direction. The passive annular anode is located at its closed bottom, in the opposite direction to the open side of this chamber intended for ion beam exit. An intense radial magnetic field inside the plasma chamber is produced by a first pole configuration about the central axis, which is surrounded by the plasma chamber. The second pole configuration surrounds the plasma chamber on the outside, as a magnetic counter-pole.

The only active cathode of Hall thrusters is located outside the discharge chamber, close to the ion beam exit. The flux of emitted electrons spreads in two directions, inwards to the discharge chamber and also along the direction of the outgoing ion beam for space charge neutralization.

The radial magnetic field into the annular discharge chamber inhibits the axial electron motion confining the electrons along ring-shaped drift paths. These radially confined electrons ionize the neutral gas introduced into the annular discharge chamber. Additionally, the high voltage applied between the active cathode and the anode produces an electric field inside the discharge chamber along its axis of symmetry that drives the ions towards its open end. This combination of radial magnetic field and axial electric field produce a fast circulating electron current around the axis of symmetry of the thruster with a slow drift towards the anode. The ions are less affected by the magnetic field and are accelerated by the axial electric field originated by the negative charge density, provided by the concentration of electrons at the open end of the thruster.

The axial thrust delivered by Hall thrusters is un-modulated and essentially determined by the physical plasma discharge parameters. Modifications of this basic scheme with more involved magnetic field configurations and improved schemes have been disclosed in U.S. Pat. No. 5,847,493, U.S. Pat. No. 7,543,441B2, U.S. Pat. No. 5,845,880 or in US 2012/0206045A1

The ionization efficiency and specific impulse of Hall thrusters are lower than those achievable by ion engines. The strong magnetic field also introduces rotational oscillations, waves and instabilities in the plasma inside the annular discharge chamber with frequencies roughly in the range from 1 kHz up to tens of MHz. In addition, ion and electron bombardment deposits over the surface of the dielectric walls of the discharge chamber important amounts of energy, in particular at the exit section. The subsequent erosion and degradation of these dielectric walls ultimately determines the lifetime of Hall thrusters.

The so-called multi-stage plasma accelerator configuration described in DE 19828704A1, U.S. Pat. No. 6,523,338B1, US 2003/0048053A1 or U.S. Pat. No. 7,084,572B2 also delivers a constant un-modulated axial thrust. As for Hall accelerators, the cylindrical discharge chamber is made of non-conductive materials and extends lengthwise with an open end for ion beam exit. The electron source is disposed in front of such open side, and also a fraction of the emitted electrons is guided into the discharge chamber. The active cathode therefore provides electrons for outgoing ion beam neutralization and also for neutral gas collisional ionization.

This discharge chamber is surrounded by ring-shaped permanent magnets with alternate polarities disposed along its longitudinal axis. They confine the electrons along a spatially periodic magnetic field along the longitudinal direction, whereas the motions of the more massive ions of the working gas are less affected. The anode is placed at the closed end of this tubular plasma chamber and additional ring-shaped intermediate electrodes are disposed inside along its longitudinal direction.

These intermediate electrodes are intended for ion acceleration and are electrically connected to increasing electric potentials. Consequently, the electrons are essentially confined close to the axis of the discharge, whereas the ions are accelerated in the direction towards the open end of the discharge chamber. Additionally, the electric field also accelerates the electrons from the active cathode downstream towards the anode. This combination of electron confinement by the magnetic field and acceleration by the local electric field increases the ionization rate of the working gas inside the discharge chamber. As with Hall plasma accelerators, ion outflow is basically determined by physical plasma discharge parameters, which control the delivered axial thrust.

The plasma streams produced by multi-stage thrusters are less collimated than those of Hall thrusters and gridded ion engines. Ion confinement is better than in Hall thrusters, except at magnetic field cusp positions along the longitudinal axis of the discharge chamber, which reduces the wear of its dielectric walls. Additionally, the radial symmetry of the magnetic field in multi-stage thrusters produces a spoke rotation regime in the plasma column along the perpendicular direction to the electric and magnetic fields, with typical frequencies of 15-35 kHz, which might cause turbulent regimes.

The plasma thruster with a multi-cusp magnetic configuration disclosed in US 2012/0167548 A1 or in EP 2414674A1 is essentially intended to provide non-axial thrust by changing the plasma jet exhaust. The cylindrical discharge chamber also having an open and a closed side is surrounded by a plurality of magnets located in the plane perpendicular to its axis of symmetry. The anode is located at the closed end of the discharge chamber and the active electron source is placed in front of its open side for working gas ionization and neutralization. In this magnetic configuration, the pole of each magnet is disposed adjacent to the like pole of the adjacent magnet and at least one of them is an electromagnet, arranged to produce a variable magnetic field.

This configuration produces constant un-modulated thrust along the axial direction depending on physical plasma discharge parameters. The control of the variable magnetic field at the open end of the discharge chamber partially deflects the ion outflow from the axis of symmetry, adding a non-axial thrust component. Alternatively, this purpose could be also achieved by means of additional passive electrodes combined with permanent magnets or electromagnets disposed outside the discharge chamber.

Variations in time and transients of the variable magnetic field introduce fluctuations of charged particle currents in the plasma. This introduces oscillations in the deflection of the plasma beam exhaust in the direction perpendicular to the axis of symmetry of the thruster that are difficult to control and therefore the delivered thrust.

BRIEF DESCRIPTION OF THE INVENTION

A different approach that addresses the shortcomings of the prior art would be desirable. The present invention advantageously proposes a plasma accelerator configuration that allows the control or modulation of throttle using only one active cathode. An exemplary embodiment provides a gridded plasma acceleration device where the voltage applied to one of such grids controls or modulates the plasma stream exhaust, and therefore the magnitude of the thrust imparted to the spacecraft.

The invention makes use of a single active cathode for both plasma discharge and ion beam neutralization, reducing the thermal impact and electric power consumption. Additionally, the voltages imparted to the grids are always below the kilovolt range, much lower than in ion engines. This reduces wear on the grids caused by electron and ion bombardment as well as the eventual electric arcing between their metallic surfaces.

The invention provides a plasma accelerator with an electrically conductive discharge chamber (e.g. metallic) extended lengthwise, preferably along an axis of symmetry, with one open end. In front of this aperture at least two parallel conductive grids are disposed, they will be called cathode grid and control grid herein. Their open spaces are aligned to facilitate the flow of charged particles there through. The invention may also comprise a supply of propellant, arranged to introduce the working gas into the discharge chamber.

This plasma accelerator configuration further comprises an electron source placed close to the control grid, which is negatively biased with respect to the electrically conductive walls of the discharge chamber. This active cathode provides electrons for both working gas ionization and outflowing ion beam neutralization. The system also includes a first power supply connected between this active cathode and the discharge chamber walls providing an acceleration voltage $V_{AC}$ for electrons and ions. This electric field drives a fraction of the electrons emitted from the electron source into the discharge chamber, passing through the open spaces of the control and cathode grids. This electric field also accelerates outwards the ions exiting towards the open end of the discharge chamber.

Inside the discharge chamber there also exists an additional electric field between its walls and at least two passive cathodes. The first passive cathode is small-sized, located along the axis of symmetry of the system inside the discharge chamber and nearby its back closed end. The second passive cathode is the cathode grid disposed in front of the open end of the discharge chamber. The system also includes a second power supply to impart an electric voltage $V_{DS}$ between discharge chamber and these two passive cathodes.

In this configuration, the electric field lines from the walls at the rear side of the discharge chamber are focused over the small central passive cathode. The electric field lines from the forward section of the discharge chamber also end along the opposite direction over the surface of the cathode grid.

A fraction of electrons from the active cathode enters into the discharge chamber, where they are accelerated along the electric field lines, increasing the collisional ionization rate thereof with the neutral gas. The ions also move along the electric field lines towards either the small cathode at the back or towards the cathode grid. Inside the discharge chamber, the ions are accelerated towards its exit section. This ion focusing effect inside the discharge chamber produces an outward ion flux that exits the discharge chamber through the aligned open spaces of the cathode and control grids. The configuration of electrodes in the present invention differs from multi-stage plasma accelerators where ion acceleration is provided by ring-shaped electrodes disposed along the inner face of the dielectric discharge chamber.

This plasma accelerator configuration also comprises a third power supply to impart the voltage $V_{CT}$ to the control grid with respect to the electrical ground. Contrary to gridded ion engines this negative voltage $V_{CT}$ is not intended for ion acceleration, but for control of throttle. The control grid is disposed between the cathode grid and the active cathode disposed outside the discharge chamber. When negatively biased, an electric potential well develops with a depth controlled by the potential $V_{CT}$ imparted to the control grid. This reduces the ionizing electron inflow from the active cathode, which is repelled by the control grid. Ion outflow is also hindered, because only a fraction of ions with energy over a threshold determined by $V_{CT}$ could move outwards past the control grid. Consequently, the control voltage $V_{CT}$ applied to the control grid allows the modulation of the ion outflow and therefore the axial thrust delivered by the plasma accelerator.

Another embodiment of the present invention further comprises a plurality of permanent magnets spaced surrounding the discharge chamber, along the thruster axis, and additionally disposed at its back closed end. These magnets have alternate polarities with their north and south poles spaced from each other in such a way that the pole of each magnet is adjacent to the opposite pole of the near magnet. The embodiment further comprises a cover that encloses the plasma accelerator, shielding the external equipment from the intense magnetic field produced by these magnets.

This preferred magnetic configuration has alternate magnetic poles both along the radial direction and along the longitudinal axis of symmetry. Therefore, the magnetic field lines along the axial and radial directions connect the surfaces of nearby magnets. This multiple-mirror configuration of magnetic field lines along the axial and radial directions restricts electron motion. The structure of multiple magnetic bottles confines the axial and radial drift motion of electrons and prevents the upsurge of plasma instabilities, enhancing the electron impact ionization rate. Otherwise, the motion of massive ions inside the discharge chamber remains unaffected by these local magnetic fields.

Such configuration of permanent magnets differs from Hall or multi-stage plasma accelerators. In the former, the magnetic field is produced by a two pole annular configuration and electron confinement essentially takes place along the radial direction, whereas the electron current circulates inside the ring-shaped discharge chamber. In the multi-stage plasma accelerator, the ring magnets are disposed along the discharge chamber and are essentially intended to confine the electrons in a spatially periodic magnetic field along the axial direction, holding the radial symmetry of the discharge chamber.

Therefore, the electrons from the active cathode that enter into the discharge chamber describe a complex motion. They are accelerated along the electric field lines between the passive cathode and the chamber walls and are also confined by multiple magnetic-mirror fields. This combined effect of electron confinement and acceleration greatly increases the collisional ionization rate of electrons with the neutral gas atoms and therefore the ion production rate.

The massive ions of the working gas are less affected by the magnetic field and essentially move along the electric field lines inside the plasma chamber. The positive charges move towards either the small passive cathode at the back or towards the cathode grid at the exit section of the discharge chamber. The ions are accelerated outwards by the electric field focusing effect and exit through the aligned open spaces of the cathode and control grids.

This plasma accelerator configuration is advantageous due to its simple structure which needs only three power supplies and requires both lower electric power and working gas consumption. Additionally, using only an active cathode has less demanding requisites for both thermal control and electrical connections. These reductions in the amount of propellant required to sustain the plasma discharge and electric energy consumption are advantageous for satellites. In particular, the available electric power is limited by the performances of solar panels and sunlight exposure along the orbit.

Preferred embodiments of the present invention will be now described by way of example only with reference to the accompanying drawings.

BRIEF DESCRIPTION OF DRAWINGS

A series of drawings which aid in better understanding the invention and which are expressly related to an embodiment of said invention, presented as a non-limiting example thereof, are very briefly described below.

DESCRIPTION OF AT LEAST ONE EMBODIMENT OF THE INVENTION

Figure 1:
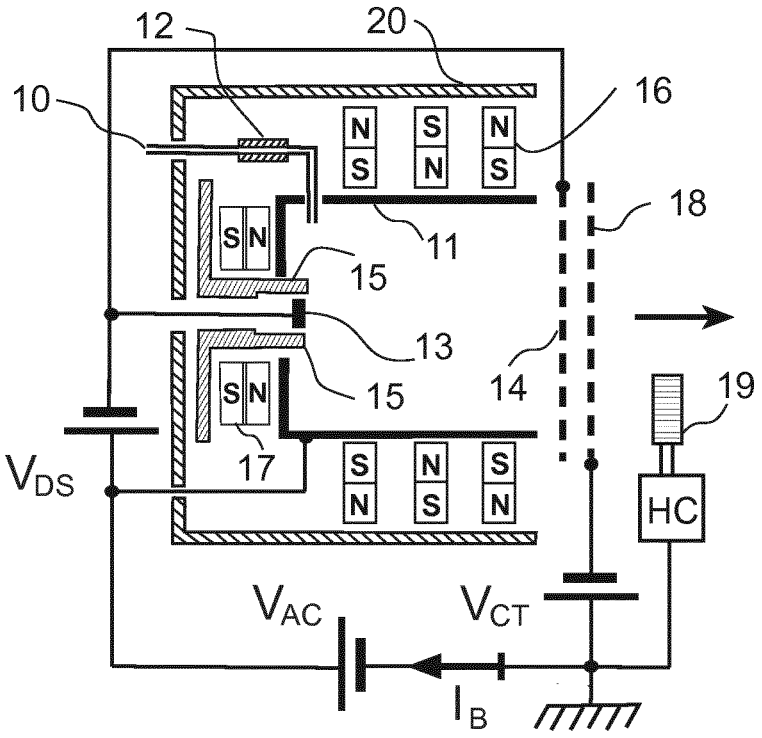
FIG. 1 is a cross-sectional plan scheme of the gridded plasma accelerator and its basic electrical connections in accordance with the preferred embodiment of present invention. The figure also shows the disposition of the crowns of permanent magnets with alternate polarities along the longitudinal direction of the discharge chamber.

FIG. 1 shows the cross sectional plan scheme along the axial direction of symmetry of the present invention with its electrical connections. The neutral gas employed as propellant is introduced through the pipe 10, into the discharge chamber 11. The pipe 10 is electrically insulated from the controlled gas leak system by the ceramic connector 12.

Figure 2:
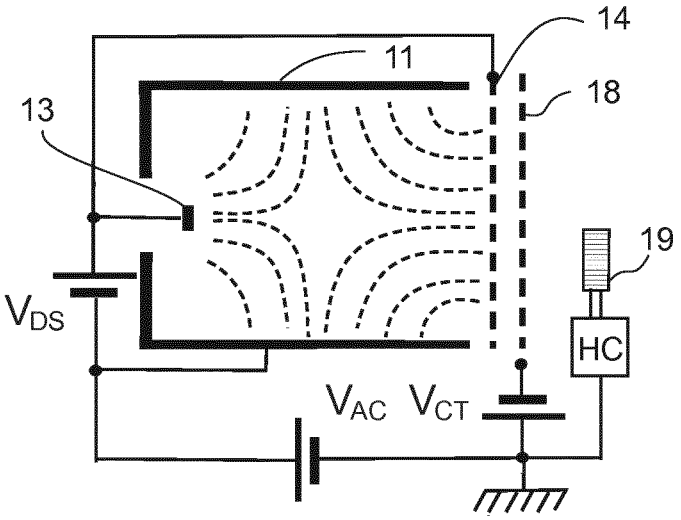
FIG. 2 is a cross-sectional plan scheme of the electric field line distribution (dotted lines) between the two passive cathodes within the discharge chamber shown in FIG. 1.

The plasma is essentially produced by the neutral gas atom collisional ionization by electrons from the active cathode 19 placed outside the discharge chamber 11. The electron source 19 can have different forms, such as a hollow cathode plasma discharge or thermionic electron emitter. This active cathode 19 provides electrons both along the direction of the control grid 18 and also in the opposite direction of the exiting ion beam indicated by the arrow in FIG. 1 for space charge neutralization. The block HC in FIGS. 1 and 2 represents control and heating and control system of the electron source 19.

A fraction of the electrons emitted from the cathode 19 enters into the discharge chamber 11 through the aligned open spaces of the control grid 18 and cathode grid 14. They are trapped inside the discharge chamber by the multiple magnetic-mirror fields produced by the crowns of permanent magnets 16 shown in FIGS. 1 and 3.

FIG. 1 shows two electrodes acting as passive cathodes; the central electrode 13 and the cathode grid 14, placed in front of the open end of the discharge chamber 11. The central cathode 13 is electrically insulated from the discharge chamber 11 by the ceramic housing 15, which places this electrode 13 over the longitudinal axis of symmetry of the system. The DC voltage $V_{DS}$ is applied between the conductive walls of the discharge chamber and the two electrically connected passive cathodes 13 and 14. The scheme of FIG. 2 shows the resulting electric field lines from this configuration of three electrodes with cylindrical symmetry around the longitudinal direction of the plasma thruster.

Figure 3:
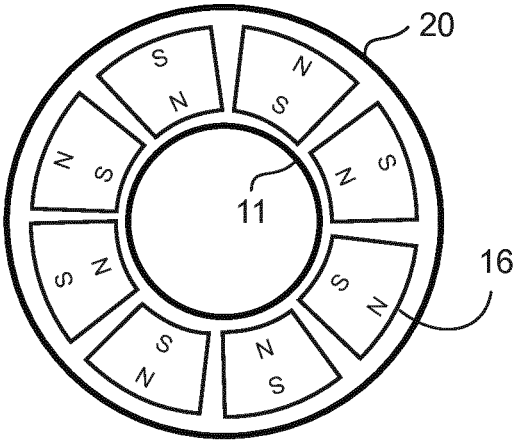
FIG. 3 is a scheme of the crowns of permanent magnets 13, also indicated in FIG. 1, which shows the permanent magnets with alternate polarities disposed concentrically around the discharge chamber 11 and enclosed by the casing 20 for the magnetic field insulation of the external equipment.

The conductive material of the discharge chamber 11 is also essentially transparent to the magnetic field produced by the permanent magnets 16 of FIGS. 1 and 3. The three crowns 16 are made of eight permanent magnets with alternate polarities shown in FIG. 3 and are placed concentrically to the discharge chamber 11. These crowns 16 of permanent magnets are also disposed as in FIG. 1 with alternate magnetic polarities along the longitudinal direction of the discharge chamber 11. Finally, a ring-shaped magnet 17 is located around the central cathode 13 placed at the closed end of the discharge chamber.

Such a configuration of permanent magnets produces a spatially periodic pattern of magnetic fields lines inside the discharge chamber 11, where the magnetic field lines connect the surfaces of the nearby magnets. The electrons perform a complex motion inside the discharge chamber where they are accelerated along the electric field lines indicated by the dotted lines in FIG. 2 and also confined by the multiple magnetic-bottle field lines (not shown in FIG. 2). This combination of electron trapping and acceleration reduces the collisional mean free path increasing ionizing collisions with neutral gas atoms. The ionization rate of the neutral gas therefore is greatly increased. The system is enclosed inside the casing 20 as illustrated in FIGS. 1 and 3. The casing 20 confines the magnetic field lines in order to protect the equipment nearby the plasma accelerator from the intense magnetic field produced by the permanent magnets 16 and 17.

The ions resulting from ionizing collisions of electrons are essentially driven along the electric field lines in FIG. 2 because they are more massive and therefore less affected by the local magnetic field. The positive charges are either attracted to the central cathode 13 or, alternatively, accelerated along the electric field lines towards the cathode grid 14.

The electric field lines of this configuration with two passive cathodes of FIG. 2 focus an important fraction of the positive ions created inside the discharge chamber towards the cathode grid 14. Consequently, a group of ions exits the discharge chamber moving along its axial direction and passing through the cathode grid 14 and the control grid 18, which have their open sections aligned.

This exiting ion outflow is accelerated downstream by the DC electric potential $V_{AC}$ imparted between the discharge chamber 11 and the electrical ground of the system as shows FIG. 1. The current $I_B$ through the power supply that delivers the acceleration voltage $V_{AC}$ is proportional to the flow of ions passing through the cathode grid 14. This electric field also accelerates upstream the electrons from the active cathode 19 passing through the grids 14 and 18 towards the discharge chamber. The energy of these ionizing electrons is also increased by the voltage $V_{AC}$ well over the ionization threshold of the neutral gas. This fact additionally increases the ionization rate inside the discharge chamber reducing the amount of neutral gas required to operate this plasma accelerator.

As in FIG. 1, the control grid 18 is biased to the DC electric potential $V_{CT}$, which acts as a control potential. When the voltage $V_{CT}$ is null, the grid 18 permits the counter flow of electrons from the active cathode 19 and ions exiting the discharge chamber 11. When the voltage $V_{CT}$ is imparted, the control grid 18 repels the electrons from the active cathode 19 moving towards the cathode grid 14. Additionally, only ions with energies over a threshold can move outwards past the control grid For low potentials $V_{CT}$, the ion current passes through the control grid 18 and is later neutralized by electrons from the active cathode 19, and this plasma jet moves in the direction indicated by the arrow of FIG. 1. This plasma stream is accelerated by the potential $V_{AC}$ and modulated by the control voltage $V_{CT}$ as indicated in FIGS. 1 and 4 imparting momentum to the spacecraft in the direction of the arrow in FIG. 1.

Additionally, several plasma accelerators could be clustered together using the same acceleration voltage $V_{AC}$ but individual control voltages $V_{CT}$ as in FIG. 1. This cluster could deliver non-axial thrust using $V_{CT}$ to control the throttle of each different plasma accelerator allowing complex maneuvers in space.

Figure 4:
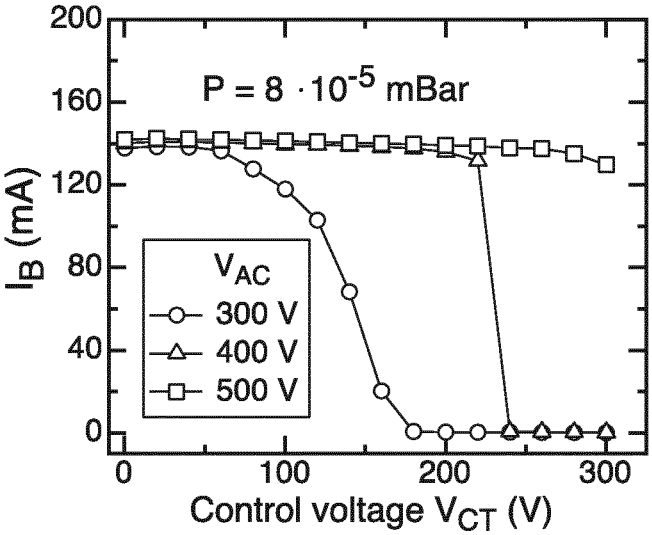
FIG. 4 represents the ion current $I_B$ against the ion beam control voltage $V_{CT}$ for different acceleration voltages $V_{AC}$ indicated in FIG. 1 as measured in an embodiment of the present invention.

The features of this plasma accelerator configuration are shown in FIG. 4, where the current $I_B$ indicated in FIG. 1 was measured in an embodiment of the present invention. The current is proportional to the counter flow of ions and electrons crossing the grids 14 and 18 in FIG. 1. The working gas pressure $p=8\cdot10^{-5}$ mB of Argon was low enough to neglect collisions between neutral atoms and charged particles. The current $I_B$ was measured for different acceleration voltages $V_{AC}$ as a function of the voltage $V_{CT}$ imparted to the control grid 18.

Control or modulation of the plasma stream by this plasma accelerator is shown in FIG. 4 through the decrement observed in the beam current $I_B$ as the control voltage $V_{CT}$ increases, holding acceleration potential $V_{AC}$ fixed. For low control voltages $I_B$ remains independent of the acceleration potential and essentially depends on the flow rates of neutral gas and ionizing electrons inside the discharge chamber. The abrupt decrement in beam current $I_B$ when $V_{CT}\approx_{AC}$ is caused by the development of a potential well between the cathode grid 14 and the active cathode 19. The voltage $V_{CT}$ imparted to the control grid 18 determines the depth of the potential well that precludes the ionizing electron inflow from the active cathode 19 as well as the ion outflow from the discharge chamber.

Additionally, it is advantageous for voltages $V_{AC}$ (300, 400 and 500 volts) and $V_{CT}$ (0-300 volts) in FIG. 4 for plasma acceleration and control to be well below those needed in the aforementioned gridded ion thrusters, in the order of a few kilovolts. These low voltages reduce the complexity of the electrical system, wear in the grids by ion bombardment, and avoid high voltage sparking. The overall electric power consumption also decreases typically below the range of 100 watts.

Although the invention has been explained in relation to its preferred embodiment(s) as mentioned above, it can be understood that many other modifications and variations can be made without departing from the scope of the present invention. It is therefore contemplated that the appended claim or claims will cover such modifications and variations that fall within the true scope of the invention.

The invention claimed is:

1. A plasma accelerator comprising:

an electrically conductive discharge chamber with an open end, means for introducing ionizable propellant inside the discharge chamber, an active cathode configured to emit electrons for ionizing the propellant and neutralizing outflowing ions, the active cathode placed outside the discharge chamber, a cathode grid being a passive cathode placed after the open end of the discharge chamber, an electrically conductive control grid placed after the cathode grid, wherein the plasma accelerator further comprises:

power supply means configured to apply:

a potential ($V_{CT}$) between the control grid and the active cathode for controlling thrust of outflowing plasma stream through the open end of the discharge chamber, a potential ($V_{AC}$) between the active cathode and the discharge chamber for accelerating electrons into the open end of the chamber and ions towards the open end of the discharge chamber and, a potential ($V_{DS}$) between the discharge chamber and the cathode grid for imparting an electric field between the discharge chamber and the cathode grid;

wherein the active cathode, the cathode grid and the control grid are arranged so as to introduce electrons emitted from the active cathode into the discharge chamber through the control grid and the cathode grid.

2. The plasma accelerator according to claim 1, wherein it further comprising an inner cathode being a passive cathode electrically connected to the cathode grid, the inner cathode placed inside the discharge chamber.

3. The plasma accelerator according to claim 1, wherein the discharge chamber extends lengthwise along an axis of symmetry.

4. The plasma accelerator according to claim 1, wherein the cathode grid and the control grid have their open spaces aligned.

5. The plasma accelerator according to any f claim 1, further comprising a plurality of magnets configured to confine electrons in the discharge chamber.

6. The plasma accelerator according to claim 5, wherein the plurality of magnets is arranged concentrically around the discharge chamber with alternate magnetic poles.

7. The plasma accelerator according to claim 5, further comprising a casing for magnetically shielding the plurality of magnets.

8. The plasma accelerator according to claim 1, wherein the active cathode is a single one.

9. The plasma accelerator according to claim 1, wherein the ionizable propellant is a monatomic or molecular gas.

10. Space borne vehicle comprising at least one plasma accelerator according to claim 1.

* * * * *